United States Patent [19]

Hübner

[11] Patent Number: 4,671,672

[45] Date of Patent: Jun. 9, 1987

[54] UNIVERSAL TIME CLOCK

[76] Inventor: Manfred Hübner, Salinenstrasse 24, 7737 Bad Dürrheim, Fed. Rep. of Germany

[21] Appl. No.: 886,242

[22] Filed: Jul. 15, 1986

[30] Foreign Application Priority Data

Jul. 27, 1985 [DE] Fed. Rep. of Germany ..... 3526945
Apr. 4, 1986 [DE] Fed. Rep. of Germany ..... 3611279

[51] Int. Cl.[4] ..... G04B 19/22
[52] U.S. Cl. ..... 368/23
[58] Field of Search ..... 368/21-24, 368/223, 228

[56] References Cited

U.S. PATENT DOCUMENTS 1,122,352 12/1914 Agnew ..... 368/23
2,036,046 3/1936 Harrison ..... 368/23
2,195,420 4/1940 Mills ..... 368/23
2,247,394 7/1941 Mills ..... 368/23
3,827,233 8/1974 Echevarria ..... 368/23

*Primary Examiner*—Vit W. Miska
*Attorney, Agent, or Firm*—Irvin A. Lavine

[57] ABSTRACT

A universal time clock that can be constructed in a very simple and inexpensive way and the globe of which is driven by the hour tube of a left-hand-rotating clockwork, a network of lines being marked on a bell-shaped top put over the globe. The lines extend from the center point of the bell-shaped top, along the shortest route, to the lower end of said bell-shaped top. For the adjusting of the network of lines, the bell-shaped top can be turned manually on the base.

7 Claims, 4 Drawing Figures

UNIVERSAL TIME CLOCK

This invention relates to a universal time clock according to the introductory part of claim 1.

A universal time clock of this type is known from U.S. Pat. No. 1,122,352, in which case, for the reading of a respective local time, on the one hand, a reading of the time of the hand of the right-hand rotating clock takes place at the clockface on the base and, on the other hand, by means of a meridian ring arranged at the bell-shaped top and a reading of a number on the meridian ring that is assigned to a desired location, a conversion to the respective local time must be carried out. The exact determination of the respective local time is therefore not very simple.

By means of the invention, an especially simply constructed universal time clock is to be created that permits a simple and fast reading of the respective local time.

In the case of a universal time clock of the initially mentioned type according to the invention, this objective is achieved by means of the characterizing part of claim 1.

For constructing the universal time clock according to the invention, a simple left-hand rotating clockwork is sufficient, according to claim 4, preferably a battery-fed quartz clockwork that is arranged in the base of the universal time clock. The hour tube of the clockwork drives not only the hour hand interacting with the clockface forming the top side of the base, but also the globe itself via the globe shaft projecting in upward direction. The network of lines located on the transparent bell-shaped top is simply, together with the bell-shaped top, put over the globe arrangement and must only be aligned to the hours of the clockface or the respective desired location on the globe. Thus, in addition to the clockwork and the globe shaft, no driving or gear element is required for the arrangement according to the invention that, at least in the northern hemisphere, makes possible a relatively exact reading of the median local time, while in the southern hemisphere, the local time can be determined with a precision that is sufficient for most uses by sighting via the lines that in this area extend vertically downward.

So that the bearing of the hour tube does not have to carry the full weight of the globe shaft and of the globe, the axial and radial pressure affecting the globe shaft, according to claim 2, can be supported by a suitable bearing. For the exact centering of the globe, a centering pin may be provided at the bell-shaped top according to claim 3.

In addition to the hour hand that is not to be read with respect to precise minutes and seconds,a digital or analog display may be provided in the clockface according to claim 5. In this case, the hand may also be left out. In principle, the clockwork can be fastened at the base by means of eccentric screws. However, preferably, according to Claim 6,it is simply fastened by means of a central screw.

By means of the figures, a preferred embodiment of the invention is explained in detail.

Figure 1:
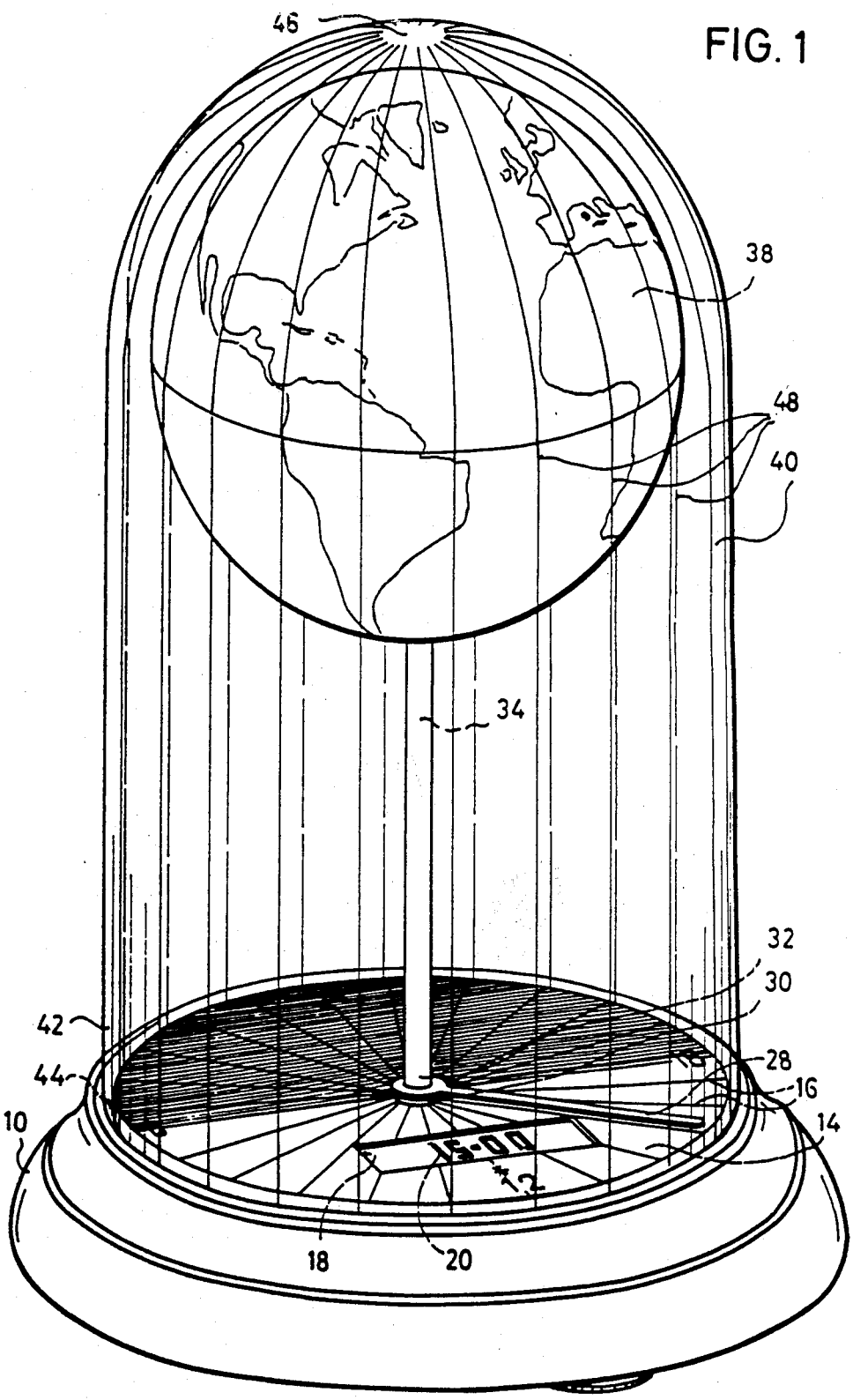
FIG. 1 is a diagonal view of the universal time clock according to the invention.
Figure 2:
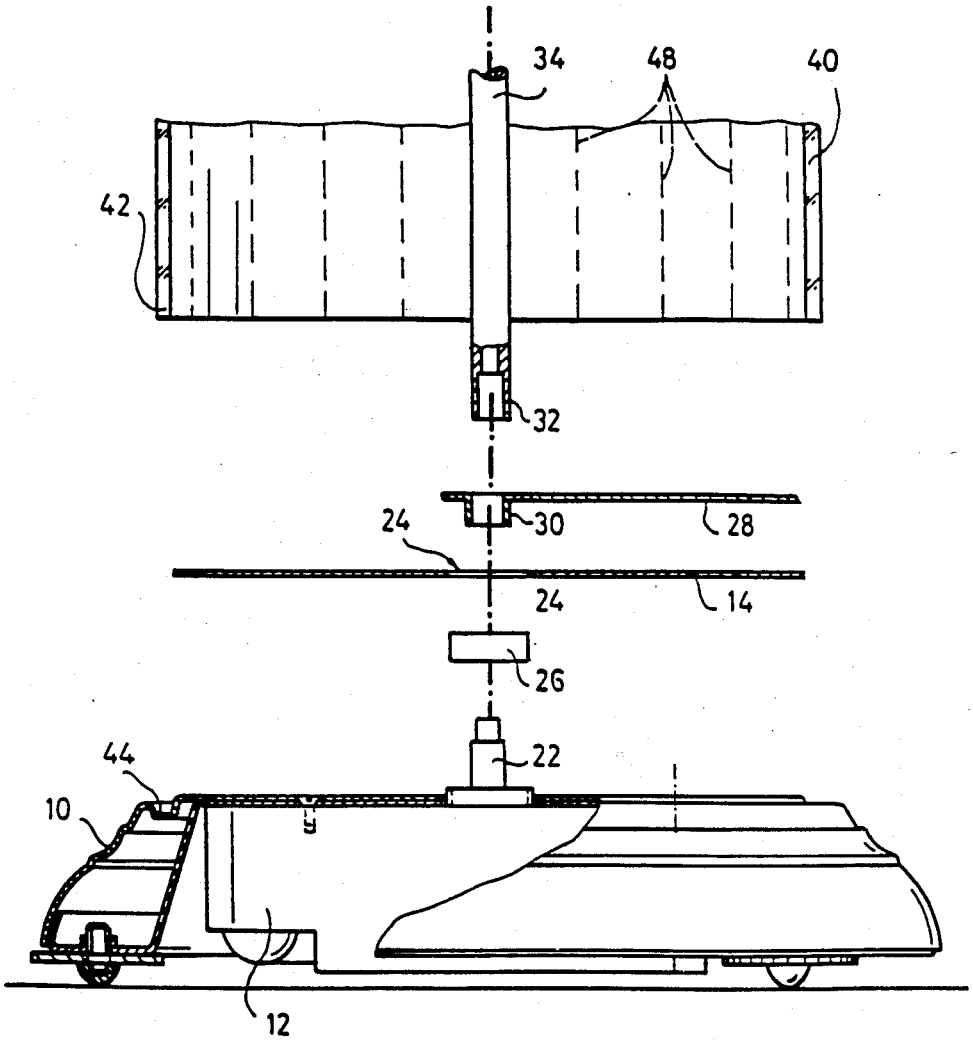
FIG. 2 is a partially cut partial side view in an exploded representation.
Figure 3:
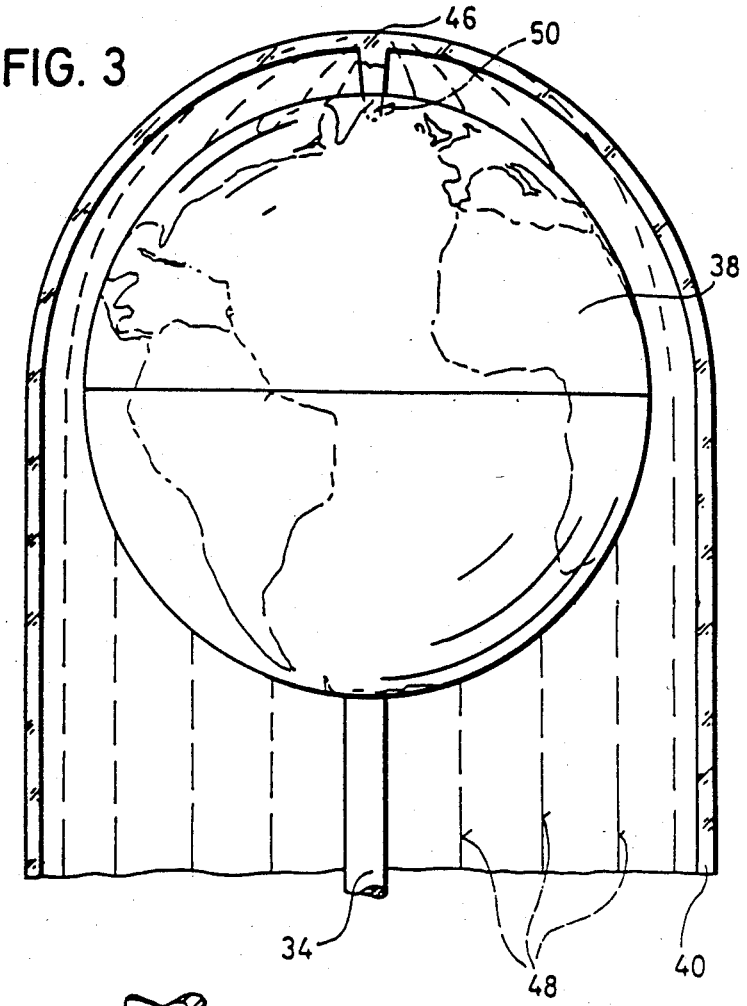
FIG. 3 is a vertical cut through the upper part of the bell-shaped top with the globe.
Figure 4:
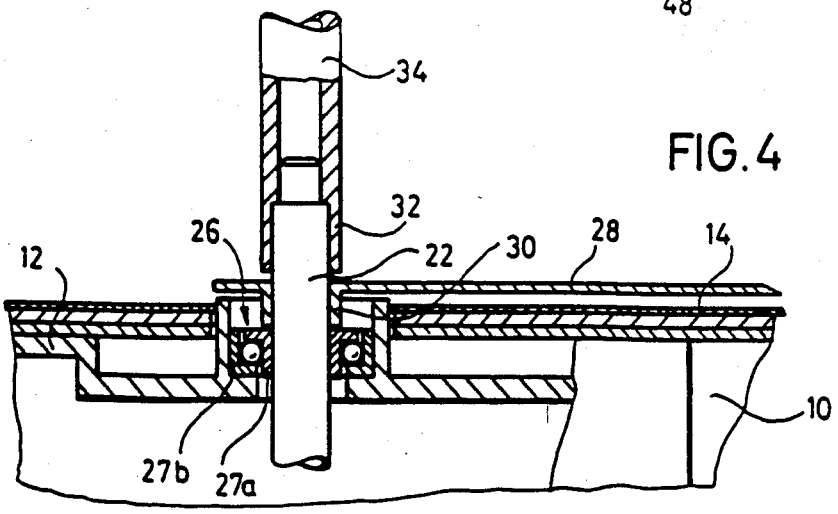
FIG. 4 is an enlarged section through the part of the universal time clock surrounding the hour tube.

The universal time clock according to the invention that is shown in the figures has a circular base 10 that serves as a housing of a battery-fed quartz clockwork 12. On the plane surface of the base, a clockface 14 having a 24-hour division 16 is fastened. In the half that corresponds to the time period from $18^h$ to $6^h$, the clockface has a darker color than in the half corresponding to the time period from $6^h$ to $18^h$, which approximately indicates day and night zones. In a rectangular opening 18 of the clockface 16, a digital display 20 for displaying the exact local time is provided that is controlled by the clockwork 12. This display may also be embedded laterally into the wall of the base. On the hour tube 22 of the clockwork 12 that from a central opening 24 of the clockface 14 projects vertically upward, an inner race 27 a of a ball thrust bearing 26, a ring 30 carrying an hour hand 28 as well as the lower end 32 of the globe shaft 34 are firmly fitted on on top of one another. The ball bearing 26 has an outer race **27*b* that is firmly connected with the base 10 or the clockwork housing and thus transfers the weight of the globe 38 fastened on the upper end of the globe shaft 34 to the base 10. This removes the load from the hour tube 22 that is in firm rotating connection with the globe shaft 34**.

A bell-shaped top 40 made of a transparent material, preferably glass or plastic,that is essentially cylindrical and sperically rounded on top is put over the globe 38, the open lower end 42 of said bell-shaped top 40 being received and supported in a groove 44 at the upper edge of the base 10 so that it can be turned by hand. A network of 24 lines 48 marked on the bell-shaped top 40 and arranged at equal distances extends from the center 46 of the bell-shaped top 40downward to the lower end 42 of the bell-shaped top 40. The lines 48 extend in parallel to the globe 38 only in the upper spherical part of the bell-shaped top 40, while in the lower cylindrical section of the bell-shaped top 40, they extend as straight lines. The lower ends of the lines 40 may be aligned with the 24-hour division 16 of the clockface 14, or one line 40 is aligned with a certain location in order to be able to conveniently read all locations with the same local time located on this line at this point in time. By means of the other lines 40 and of the clockface 14, comparatively precisely the local time can be determined for any location entered on the globe 38.

A centering pin 50 projects downward from the center 46 of the bell-shaped top 40, the globe 38 being disposed on said centering pin 50 so that it can be rotated on its upper side. This bearing is not necessary when the globe shaft 34, by means of the ball bearing 25,is sufficiently supported with respect to the base 10.

I claim:

1. A universal time clock having a base carrying a 24-hour clockface, an hour tube projecting vertically upward from the center of said clockface, and having a globe fastened on a driven globe shaft projecting in upward direction from said base and being fastened on said hour tube, said globe being surrounded by a cage in the form of a bell-shaped top made of a transparent material, the open lower end of said bell-shaped top being supported on said base, an hour hand interacting with said base while reaching around said clockface, a clockwork being mounted in said base, and an hour hand interacting with said clockface, wherein on said bell-shaped top lines are marked that enclose equal distances, said lines extending from the center of said bell-shaped top on the shortest route to the lower end of said bell-shaped top, wherein said clockwork rotates to the left, and wherein said bell-shaped top is rotatably arranged on said base.

2. A universal time clock according to claim 1, wherein the load affecting said globe shaft is supported on said base via a roller bearing.

3. A universal time clock according to claim 1 or 2, wherein said globe, on the upper side, is rotatably disposed on a centering pin projecting downward from said bell-shaped top.

4. A universal time clock according to claim 1, wherein said clockwork is a battery-fed quartz clockwork.

5. A universal time clock according to claim 1, wherein, in said clockface, a digital display is provided for the display of the exact local time.

6. A universal time clock according to claim 1, wherein said clockwork is fastened at said base by means of a central screw.

7. A universal time clock according to claim 1, wherein, in said clockface, an analog display is provided for the display of the exact local time.

* * * * *